US012213601B2

(12) United States Patent
Obitts et al.

(10) Patent No.: US 12,213,601 B2
(45) **Date of Patent: *Feb. 4, 2025**

(54) RETAIL SHELVING SYSTEM

(71) Applicant: Fasteners for Retail, Inc., Twinsburg, OH (US)

(72) Inventors: Shane Obitts, North Ridgeville, OH (US); Billy Mertz, Cincinnati, OH (US); Matt Grubbs, Union, KY (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/826,769

(22) Filed: May 27, 2022

(65) Prior Publication Data

US 2022/0287480 A1 Sep. 15, 2022

Related U.S. Application Data

(63) Continuation of application No. 16/222,722, filed on Dec. 17, 2018, now Pat. No. 11,369,215.

(51) Int. Cl.

| | |
|---|---|
| ***A47B 96/02*** | (2006.01) |
| ***A47B 57/04*** | (2006.01) |
| ***A47B 96/06*** | (2006.01) |
| ***A47F 1/12*** | (2006.01) |
| ***A47F 5/00*** | (2006.01) |
| ***A47F 5/08*** | (2006.01) |
| ***A47F 5/10*** | (2006.01) |

(Continued)

(52) U.S. Cl.

CPC ..... *A47F 1/12* (2013.01); *A47B 57/04* (2013.01); *A47F 5/0018* (2013.01); *A47F 5/0043* (2013.01); *A47F 5/103* (2013.01); *A47B 96/024* (2013.01); *A47B 96/061* (2013.01); *A47B 96/07* (2013.01); *A47B 96/1408* (2013.01)

(58) Field of Classification Search

CPC ..... A47B 57/04; A47B 57/42; A47B 57/045; A47B 47/022; A47B 45/00; A47B 96/021; A47B 96/024; A47B 96/027; A47B 96/028; A47B 96/1408; A47B 96/061; A47B 96/067; A47F 51/12; A47F 5/0018; A47F 5/0043; A47F 5/103; A47F 1/12

See application file for complete search history.

(56) References Cited

U.S. PATENT DOCUMENTS

| | | | |
|---|---|---|---|
| 1,354,270 | A | 9/1920 | Wood |
| 1,677,764 | A | 7/1928 | Gloekler |

(Continued)

FOREIGN PATENT DOCUMENTS

| | | | |
|---|---|---|---|
| CA | 1037908 | A | 9/1978 |
| CA | 2725928 | A1 | 6/2011 |

(Continued)

*Primary Examiner* — Kimberley S Wright

(74) *Attorney, Agent, or Firm* — Reinhart Boerner Van Deuren P.C.

(57) ABSTRACT

A shelving system is provided. The shelving system includes an upper rail, and optionally a lower rail, from which one or more upright supports extend. The upright supports are slidable within the upper and lower rails so that a user may vary their location. A shelf mounts to the upright supports. The shelf includes interlocking deck panels and selectively removable support bars so that it may be assembled onto the upright supports.

22 Claims, 15 Drawing Sheets

(51) Int. Cl.
*A47B 96/07* (2006.01)
*A47B 96/14* (2006.01)

(56) References Cited

U.S. PATENT DOCUMENTS 2,091,599 A 8/1937 Larson et al.
2,191,701 A 2/1940 Wood
2,633,998 A 4/1953 Henrietta et al.
2,790,559 A 4/1957 Stephenson et al.
2,940,601 A 6/1960 Smith
2,975,908 A 3/1961 Huet
3,082,880 A 3/1963 Mapson
3,185,426 A 5/1965 Johan
3,196,812 A 7/1965 Jacques
3,225,940 A 12/1965 Story
D214,923 S 8/1969 Schier
3,556,306 A 1/1971 Shell
3,733,755 A * 5/1973 Butler ..... E04B 2/7854 211/187
3,832,957 A 9/1974 Mendenhall
3,965,826 A 6/1976 Markham
3,986,462 A 10/1976 Heft
4,018,167 A 4/1977 Spangler
4,081,880 A 4/1978 Edeus
4,098,480 A 7/1978 Neumann
4,118,087 A 10/1978 Dorf
4,431,155 A 2/1984 Engel
4,455,007 A 6/1984 Varon et al.
4,760,930 A 8/1988 Fox
4,874,148 A 10/1989 Guinter
5,110,080 A * 5/1992 Rieman ..... A47B 96/1408 248/225.11
5,158,187 A 10/1992 Taub
5,253,837 A 10/1993 Loux
5,257,701 A 11/1993 Edelson
5,277,393 A 1/1994 Nicholson et al.
5,313,891 A * 5/1994 Suttles ..... A47B 47/022 211/186
5,356,106 A 10/1994 Trotta et al.
5,638,644 A 6/1997 Bastain
5,709,158 A 1/1998 Wareheim
5,738,019 A 4/1998 Parker
5,769,247 A * 6/1998 Merl ..... A47B 47/022 211/88.01
5,893,470 A 4/1999 Peggs
5,921,411 A 7/1999 Merl
5,964,163 A 10/1999 Cohen
6,168,032 B1 1/2001 Merl
6,234,328 B1 5/2001 Mason
6,401,945 B1 6/2002 Gawel
6,405,557 B1 6/2002 DeCastro et al.
6,669,154 B1 12/2003 Remmers
D490,697 S * 6/2004 Runnalls ..... D8/380
6,820,757 B2 11/2004 Craft et al.
6,892,993 B2 5/2005 Palmer
6,962,116 B2 11/2005 Bieniek et al.
D526,887 S * 8/2006 Remmers ..... D8/380
7,086,544 B1 * 8/2006 Doench ..... A47B 96/028 248/222.51
7,131,547 B2 11/2006 Gawel
7,150,364 B2 12/2006 Jablow et al.
D543,094 S * 5/2007 Remmers ..... D8/377
7,225,935 B2 6/2007 Breymaier et al.
7,300,122 B2 11/2007 Vardon
7,347,336 B1 3/2008 Williams et al.
7,497,344 B2 3/2009 Chen
7,654,497 B1 2/2010 Karan
8,087,522 B2 1/2012 Stafford et al.
8,434,629 B2 5/2013 Fernandez
8,627,966 B2 1/2014 Jarvis et al.
8,646,624 B2 * 2/2014 Fernandez ..... A47B 57/42 211/90.03
8,657,130 B2 * 2/2014 Thrush ..... A47F 5/0892 211/175
8,899,162 B2 12/2014 Chikkakalbalu
8,905,248 B1 12/2014 Wolski
8,985,350 B2 * 3/2015 Thrush ..... A47B 96/025 211/175
8,998,009 B2 4/2015 Kim et al.
9,119,471 B2 9/2015 Gonzalez et al.
9,289,065 B1 3/2016 Lambertson
9,445,669 B2 9/2016 Li et al.
9,468,312 B2 10/2016 Denby
9,474,374 B2 10/2016 Reinhart
9,486,090 B2 11/2016 Juric
9,532,662 B2 1/2017 Desmond
9,538,846 B2 1/2017 Reinhart et al.
9,538,859 B1 1/2017 Johnson et al.
9,578,976 B2 2/2017 Grubbs et al.
D803,671 S 11/2017 Neelagantan et al.
9,877,600 B1 1/2018 Lin
10,021,972 B1 7/2018 Robinson et al.
10,051,959 B1 8/2018 Glidewell
10,123,617 B2 11/2018 Rollins et al.
10,182,652 B1 1/2019 Spielmann et al.
10,213,016 B2 2/2019 Bellar et al.
10,231,544 B2 3/2019 Reinhart
10,334,970 B2 * 7/2019 Buck ..... A47B 57/406
10,638,856 B2 5/2020 Nagel et al.
10,709,237 B2 7/2020 Robinson et al.
10,905,239 B2 2/2021 Newman
11,350,743 B2 6/2022 Reinhart et al.
11,369,215 B2 6/2022 Obitts et al.
11,583,110 B2 * 2/2023 Smedley ..... A47F 5/103
2001/0050262 A1 * 12/2001 LaBruna, Jr. ..... A47F 5/103 211/103
2003/0159344 A1 8/2003 Vandewiele et al.
2004/0159622 A1 8/2004 Craft et al.
2004/0182804 A1 9/2004 Harper
2005/0127017 A1 6/2005 Kessel et al.
2005/0263465 A1 12/2005 Chung
2006/0011568 A1 * 1/2006 Remmers ..... A47B 96/00 211/90.03
2007/0119798 A1 * 5/2007 Hanretty ..... A47F 1/12 211/59.2
2007/0221103 A1 9/2007 Trausch
2008/0272076 A1 11/2008 Davenport
2009/0223912 A1 9/2009 Chen
2009/0308290 A1 12/2009 Bohnacker
2010/0116760 A1 5/2010 Fazzone
2010/0213334 A1 8/2010 Davenport
2010/0224582 A1 * 9/2010 Loy, II ..... A47B 53/00 211/151
2010/0300999 A1 12/2010 Schwartzkopf et al.
2011/0147323 A1 * 6/2011 Sainato ..... A47F 1/12 40/642.02
2011/0155677 A1 * 6/2011 Fernandez ..... A47B 57/42 211/183
2011/0186533 A1 * 8/2011 Thrush ..... A47B 96/025 211/113
2011/0204014 A1 8/2011 Miller et al.
2012/0018392 A1 * 1/2012 Peota ..... F16B 12/50 211/186
2012/0084961 A1 4/2012 Stafford et al.
2014/0034591 A1 2/2014 Szpak et al.
2015/0027972 A1 1/2015 Andersson et al.
2015/0173528 A1 6/2015 Hester-Redmond
2017/0071364 A1 3/2017 Turner et al.
2017/0202368 A1 7/2017 Bird et al.
2018/0132611 A1 * 5/2018 Lu ..... A47B 61/003
2018/0153313 A1 6/2018 Padvoiskis et al.
2018/0153316 A1 * 6/2018 Buck ..... A47F 5/103
2018/0360211 A1 12/2018 Lu et al.
2018/0360236 A1 * 12/2018 Kim ..... A47F 1/04
2020/0139664 A1 5/2020 Ohara et al.
2020/0187675 A1 6/2020 Obitts et al.
2021/0199490 A1 7/2021 Fritsch et al.
2021/0330081 A1 10/2021 McMillin et al.
2021/0330094 A1 * 10/2021 Smedley ..... A47F 5/0043
2021/0369011 A1 * 12/2021 Smedley ..... A47F 5/0018
2022/0031070 A1 2/2022 Brunner et al.

(56) References Cited

U.S. PATENT DOCUMENTS

| | | | |
|---|---|---|---|
| 2022/0160124 | A1 | 5/2022 | Hollis |
| 2023/0147456 | A1 | 5/2023 | Smedley et al. |

FOREIGN PATENT DOCUMENTS

| | | | |
|---|---|---|---|
| CN | 2480510 | Y | 3/2002 |
| CN | 1655705 | A | 8/2005 |
| CN | 108477884 | A | 9/2018 |
| CN | 207848127 | U | 9/2018 |
| CN | 108703590 | A | 10/2018 |
| CN | 108884848 | A | 11/2018 |
| DE | 9420293 | U1 | 2/1995 |
| DE | 29621679 | U1 | 2/1997 |
| DE | 29802700 | U1 | 5/1998 |
| DE | 202011002872 | U1 | 6/2011 |
| DE | 202018005669 | U1 | 2/2019 |
| DE | 202019003006 | U1 | 8/2019 |
| DE | 102018108923 | A1 | 10/2019 |
| DE | 202018003945 | U1 | 11/2019 |
| DE | 202019103867 | U1 | 10/2020 |
| FR | 2906694 | A1 | 4/2008 |
| KR | 20070107919 | A | 11/2007 |
| WO | WO 01/34006 | A1 | 5/2001 |
| WO | WO 03/063646 | A2 | 8/2003 |
| WO | WO 2012/032517 | A1 | 3/2012 |
| WO | WO 2019/145948 | A1 | 8/2019 |

* cited by examiner

RETAIL SHELVING SYSTEM

CROSS-REFERENCE TO RELATED PATENT APPLICATIONS

This patent application is a continuation of co-pending U.S. patent application Ser. No. 16/222,722, filed Dec. 17, 2018, which is now pending, the entire teachings and disclosure of which are incorporated herein by reference thereto.

FIELD OF THE INVENTION

This invention generally relates to retail displays, and more particularly to retail shelving systems.

BACKGROUND OF THE INVENTION

Retail shelving is a staple in the retail merchandise environment. While such shelving comes in many forms, it generally includes a vertical support structure which supports one or more shelves extending outwardly from the vertical structure. The vertical structure is typically a wall-like structure and contains integrated mounting rails, referred to in in the industry as gondola uprights, which the shelves mount to. However, the vertical structure and its gondola uprights offer minimal customization for mounting the shelves in a variety of arrangements.

Further, certain retail displays may not include their own integrated gondola uprights. For non-limiting example, a refrigerated case for containing produce may not have integrated gondola uprights for a variety of reasons, one being that it may not have been originally designed to incorporate gondola mounted shelves, another being that such cases are typically designed to only accept the case manufacturers shelving and thus does not offer any customization.

In such an instance, a separate grid structure that may contain gondola uprights is first mounted to a back wall of the refrigerated case. Thereafter, shelving can be mounted to this grid structure, ultimately to present a shelving arrangement similar to that for displaying non-refrigerated items. While such a configuration has a distinct advantage of allowing the retailer to introduce a shelving arrangement in a display not originally designed for shelving, it is not without its drawbacks.

Indeed, the grid structure is a relatively large welded structure. Because it is welded, shipping this large structure in its pre-assembled state can be costly and cumbersome. Further, because the grid structure is a welded structure, its gondola uprights are fixed. Such grid systems typically include five fixed gondola uprights. However, the particular shelving configuration selected by the end user may necessitate the use of less than all five gondola uprights, leaving the remaining gondola uprights unused yet part of the assembly. Furthermore, the welding process necessitate the use of robust materials, which in turn results in a relatively heavy structure that tends to be difficult to install.

Yet further, the shelves of such shelving systems also present several drawbacks. These shelves are typically steel structures which can corrode over time and which are heavy making them difficult to remove for cleaning. One alternative has been to utilize aluminum shelving instead, but this material results in a more costly system. Also, such steel or aluminum shelves do not meet the requirements for NSF Certification by NSF International, which is a highly desired certification in certain retail display applications in which the shelving surface comes into direct contact with the product being merchandised.

Accordingly, there is a need in the art for a retail shelving system which addresses the above drawbacks of existing shelving systems. The invention provides such a retail shelving system. These and other advantages of the invention, as well as additional inventive features, will be apparent from the description of the invention provided herein.

BRIEF SUMMARY OF THE INVENTION

In one aspect, the invention provides shelving system. An embodiment of such a shelving system includes an upper rail defining an upper channel. The upper rail is configured to mount to a support structure. This embodiment also includes at least one upright support. The at least one upright support has an upper end and a lower end. The upper end is received in the upper channel. The lower end is received in the lower channel. The at least one upright support is slidable in the upper channel. This embodiment also includes at least one shelf mounted to the at least one upright supports.

In embodiments according to this aspect, the upper rail includes a mounting shelf. The at least to upright supports include a channel for receiving the mounting shelf.

In embodiments according to this aspect, the shelving system also includes a lower rail defining a lower channel configured to mount to the support structure separately from the upper rail. The lower rail includes a bottom wall and a lip depending upwardly from the bottom wall which bound the lower channel. The lip of the lower rail includes at least one access opening. The at least one access opening allowing access through the lip of the lower rail to the lower channel. The lower end of the at least one upright support is received in the lower channel.

In embodiments according to this aspect, the upper rail includes an upper wall and a lip depending downwardly from the upper wall which bound the upper channel. An extension length of the lip of the upper rail from the upper wall is less than an extension length of the lip of the lower rail from the lower wall.

In embodiments according to this aspect, each of the upper and lower rails includes a pair of mounting structures for mounting the upper and lower rails to the support structure. Each of the pair of mounting rails includes a front plate and a back plate, the back plate slidable relative to the front plate.

In embodiments according to this aspect, the at least one upright support includes first and second upright supports, and the shelf includes a first and a second support arm. The first support arm is mounted to one of the first and second upright supports. The second support arm is mounted to the other one of the first and second upright supports. The first and second support arms are arranged in opposed spaced relation to one another. A front support bar extends between the first and second support arms. A rear support bar extends between the first and second support arms. At least one deck panel is supported by the front and rear support bars. The at least one deck panel is configured to interlock with an adjacent deck panel such that the at least one deck panel is prevented from laterally moving relative to the adjacent deck panel along the front and rear support bars.

In embodiments according to this aspect, the front and rear support arms each include a front mounting post and a rear mounting post. The front support bar includes a channel. The channel of the front support bar receives the front mounting posts of the first and second support arms such that the front support bar is selectively removable from the first and second support arms. The rear support bar also includes a channel. The channel of the rear support bar receives the rear mounting posts of the first and second support arms such that the rear support bar is selectively removable from the first and second support arms.

In embodiments according to this aspect, the at least one deck panel includes a plurality of tabs extending from a bottom surface of the deck panel. The plurality of tabs are configured to be received in corresponding openings of the adjacent deck panel. The at least one deck panel includes a lip that provides a plurality of openings for receiving a plurality of tabs of the adjacent deck panel.

In another aspect, the invention provides a modular shelf for a shelving system. The shelving system includes at least one rail configured to mount to a support structure, and at least one upright support extending from the at least one rail. The shelf includes a first and a second support arm arranged in opposed spaced relation to one another. At least one support bar is mounted to the first and second support arms. This embodiment of the shelf also includes at least one deck panel supported by the at least one support bar. The at least one deck panel is configured to interlock with an adjacent deck panel such that the at least one deck panel is prevented from laterally moving relative to the adjacent deck panel along the front and rear support bars.

In embodiments according to this aspect, the at least one deck panel includes an integrated baffle support and a plurality of tabs extending from a bottom surface of the deck panel. The plurality of tabs are configured to be received in corresponding openings of the adjacent deck panel. The at least one deck panel also includes a lip providing a plurality of openings for receiving a plurality of tabs of the adjacent deck panel.

In embodiments according to this aspect the at least one support bar includes front and rear support bars. Each of the front and rear support bars include a channel. The channel of the front support bar receives front mounting posts of the first and second support arms such that the front support bar is selectively removable from the first and second support arms. The channel of the rear support bar receives rear mounting posts of the first and second support arms such that the rear support bar is selectively removable from the first and second support arms In embodiments according to this aspect, the at least one deck panel includes a honeycomb structure having at least one channel for receiving the at least one support bar. The at least one channel includes a plurality of finger tabs for affixing the at least one deck panel to the at least one support bar.

In another aspect, the invention provides a shelving system. An embodiment of such a shelving system includes an upper rail configured to mount to a support structure, a lower rail configured to mount to a support structure, and at least two upright supports extending between the upper and lower rails. This embodiment also includes at least one shelf mounted to the at least two upright supports. The at least one shelf comprising a first and a second support arm. Each of the first and second support arms includes a front mounting post and a rear mounting post. This embodiment of a shelf also includes a front support bar extending between the first and second support arms. The front support bar includes a channel. The channel of the front support bar receives the front mounting posts of the first and second support arms such that the front support bar is selectively removable from the first and second support arms. This embodiment also includes a rear support bar extending between the first and second support arms. The rear support bar includes a channel. The channel of the rear support bar receives the rear mounting posts of the first and second support arms such that the rear support bar is selectively removable from the first and second support arms. This embodiment of a shelf also includes at least one deck panel supported by the front and rear support bars.

In embodiments according to this aspect, the upper rail includes an upper channel, and the he lower rail includes a lower channel. Each of the at least two upright supports has an upper end and a lower end. The upper end is received in the upper channel, and the lower end is received in the lower channel. The at least two upright supports are slidable in the upper and lower channels.

In embodiments according to this aspect, the at least one deck panel is configured to interlock with an adjacent deck panel. The at least on deck panel includes a front and a rear channel for receiving the front and rear support bars, respectively.

In embodiments according to this aspect, the at least one deck panel includes opposed side edges A plurality of tabs extend from a bottom surface adjacent one of the opposed side edges of the deck panel. The at least one deck panel includes a lip adjacent the other one of the opposed side edges. The lip provides a plurality of openings for receiving a plurality of tabs of the adjacent deck panel.

In another embodiment, the invention provides a method of installing a shelving system. An embodiment of such a method includes mounting an upper rail having an upper channel to a support structure, mounting at least one upright support having an upper end and a lower end to the upper rail such that the upper end of the first upright support is disposed within the upper channel, mounting a first support arm of a at least one shelf to the at least one upright support, mounting a second support arm of the at least one shelf to the at least one upright support, situating at least one support bar such that it extends between the first and second support arms, and affixing a first deck panel onto the at least one support bar.

In embodiments according to this aspect, the step of mounting the at least one upright support includes mounting a first and a second upright support to the upper rail, and further includes linearly inserting the upper end of each of the first and second upright supports into the upper channel, and sliding the first and second upright supports into first and second positions, respectively.

In embodiments according to this aspect, the method also includes separately mounting a lower rail having a lower channel to the support structure below the upper rail. Mounting the at least one upright support includes mounting the at least one upright support to the upper and lower rails such that the upper end is received in the upper channel and the lower end is received in the lower channel. The method also includes rotating the at least one upright support such that the lower end thereof passes through an opening in the lower mounting rail to seat within the lower channel.

In embodiments according to this aspect, the step of situating the at least one support bar includes situating front and rear support bars on a mounting post of each support arm within a channel of each support bar.

In embodiments according to this aspect, the method also includes affixing a second deck panel onto the at least one support bar such that the first and second deck panels interlock.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, the same illustrate an embodiment of a shelving system according to the teachings herein. As will be understood from the following, the shelving system provides several advantages over existing designs. First, it utilizes an upper rail and a lower rail which are separately mountable from one another. A number of upright supports are slidably received by these upper and lower rails. As a result, an installer can easily mount the upper rail, then mount the lower rail, and then slide the upright supports into the rails. This is a distinct departure from prior designs which employ a grid structure that is welded together as a one piece unit.

Second, the shelving system according to the teachings herein utilizes shelves which may be assembled onto the upright supports once they are installed. This is a distinct advantage over prior designs which require lifting a shelf as a unit onto a grid structure. Instead, according to the teachings herein, the shelf is rapidly assembled piece by piece in place. As a result, relatively light parts are lifted during installation, which are also far less cumbersome. Third, the shelf or shelves of the current application utilize plastic deck panels which may be formed of a NSF compliant material. Fourth, because both the rails, the upright supports, and shelf or shelves are designed to be assembled during installation, they may be shipped in a much smaller container than in prior designs. Fifth, due to the size and modular nature of the deck panels, these panels may be easily removed for cleaning in a sink or dishwasher. This is a distinct advantage over prior designs, which require removing the entirety of the shelf as a single unit and washing the same in a cleaning area which accommodates cleaning of relatively large objects. These and other advantages will become more apparent from the disclosure herein.

Figure 1:
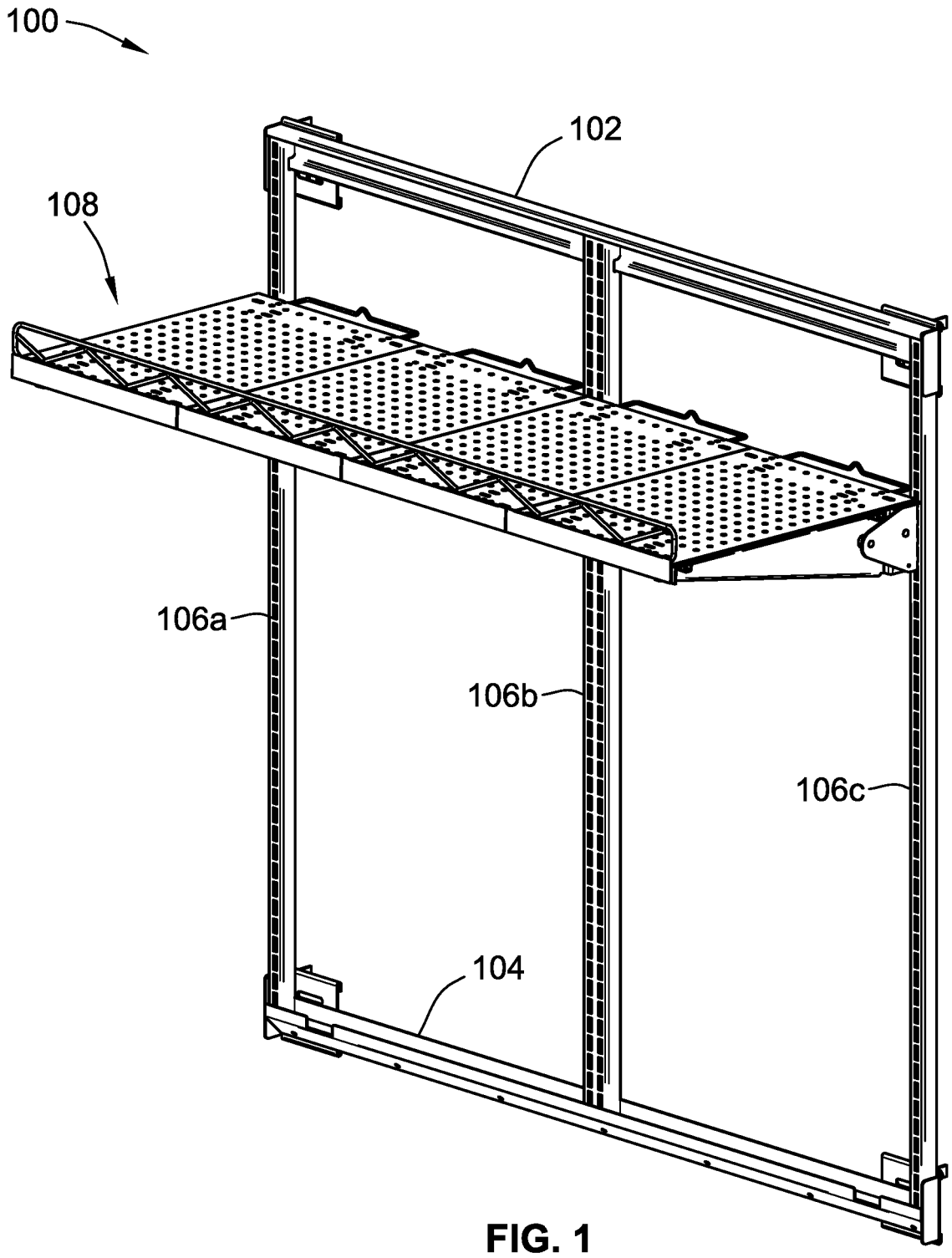
FIG. 1 is a perspective view of an exemplary embodiment of a retail shelving system according to the teachings herein.

With specific reference now to FIG. 1, the same illustrates an exemplary embodiment of a shelving system 100 according to the teachings herein. Shelving system 100 includes a grid assembly with one or more shelves 108 mounted thereto. While one shelf 108 is shown, it is contemplated that any number of shelves may be mounted to this grid assembly. Further, while shelf 108 illustrated the full length of the grid assembly, shorter shelf lengths are entirely possible due to the highly customizable nature of the grid assembly and through the use of a common and modular deck panel as discussed below.

The grid assembly itself consists of a number of separate and distinct components which will be discussed in turn. As mentioned above, this approach of having separate components has a distinct advantage over grid structures of prior designs which are a welded structure which is relatively large and cumbersome.

The grid assembly includes an upper rail 102 and a separate lower rail 104. Upper and lower rails 102, 104 are configured to mount to a support structure such as a vertical wall, the interior of a refrigerated or freezer case, etc. Indeed, upper and lower rails 102, 104 may be adapted to mount to any structure capable of supporting the same. As such, upper and lower rails 102, 104 may incorporate any mounting expedient.

One advantageous feature of upper and lower rails 102, 104 is that they are separate components. As a result, they may be separately installed to the aforementioned support structure. This makes installation considerably easier than in prior designs which require lifting a large welded grid structure as a single unit and installing it in place on a support structure.

A plurality of upright supports 106*a*, 106*b*, 106*c* are slidably received in upper and lower rails 102, 104. As will be explained below, rails 106*a-c* are used for mounting shelf 108 thereto. It should be noted that three upright supports 106*a-c* are illustrated for purposes of description. However, only the outer most upright supports 106*a*, 106*c* are needed for mounting the illustrated shelf 108. Multiple additional shelves 108 may mount to the same two upright supports 106*a*, 106*c* below shelf 108 as illustrated. Further, shelves 108 having a shorter length may be mounted between upright supports 106*a* and 106*b*, or between upright supports 106*b* and 106*c*. Unless otherwise specifically noted herein, any description of the structure, function, or use of one upright support 106*a-c* applies equally to the others.

One advantage having separate upright supports 106*a-c* is the ability to add or remove a desired number of upright supports as discussed below to allow for a specific shelving configuration. This is a distinct departure from prior welded designs as discussed above. In such welded designs, a fixed number of upright supports are provided, making customization difficult. The number of upright supports which may be included in the current application will be entirely dependent upon the shelving configuration desired. Therefore, the three upright supports 106*a-c* should be taken as only one of many possible examples. While two rails 102, 104 are shown and described, it is contemplated that only a single upper rail 102 could be utilized for receiving and supporting upright supports 106*a-c*.

Figure 2:
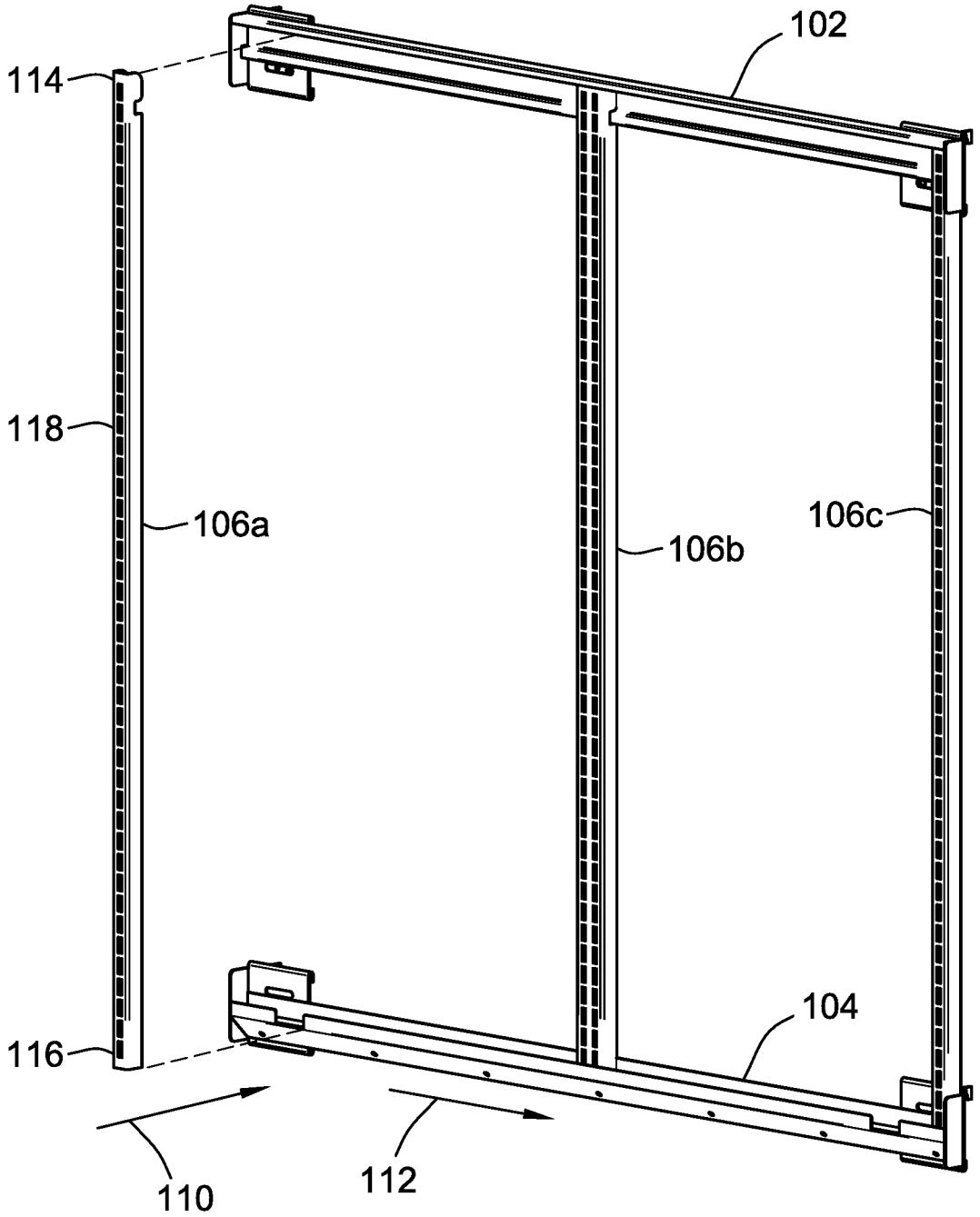
FIG. 2 is a perspective exploded view of a grid assembly of the retail shelving system of FIG. 1.

Turning now to FIG. 2, once upper and lower rails 102, 104 are installed, each upright support 106*a-c* is installed by generally situating the upright supports 106*a-c* into upper and lower rails 102, 104 by moving them generally in direction 110, and then sliding them in direction 112 to their final destinations. Upper and lower rails 102, 104 are designed such that they each include a channel within which the end portions of the upright supports 106*a-c* are situated and slidable in.

Indeed, referring specifically to upright support 106*a* shown in FIG. 2, the same includes an upper end 114 and a lower end 116. A plurality of apertures 118 are formed therein for shelf mounting. These apertures 118 may take on any shape. An identical description to that of upright support 106*a* applies to 106*c*. Upright support 106*c* differs only in that it include two parallel rows of apertures 118 as illustrated.

Figure 3:
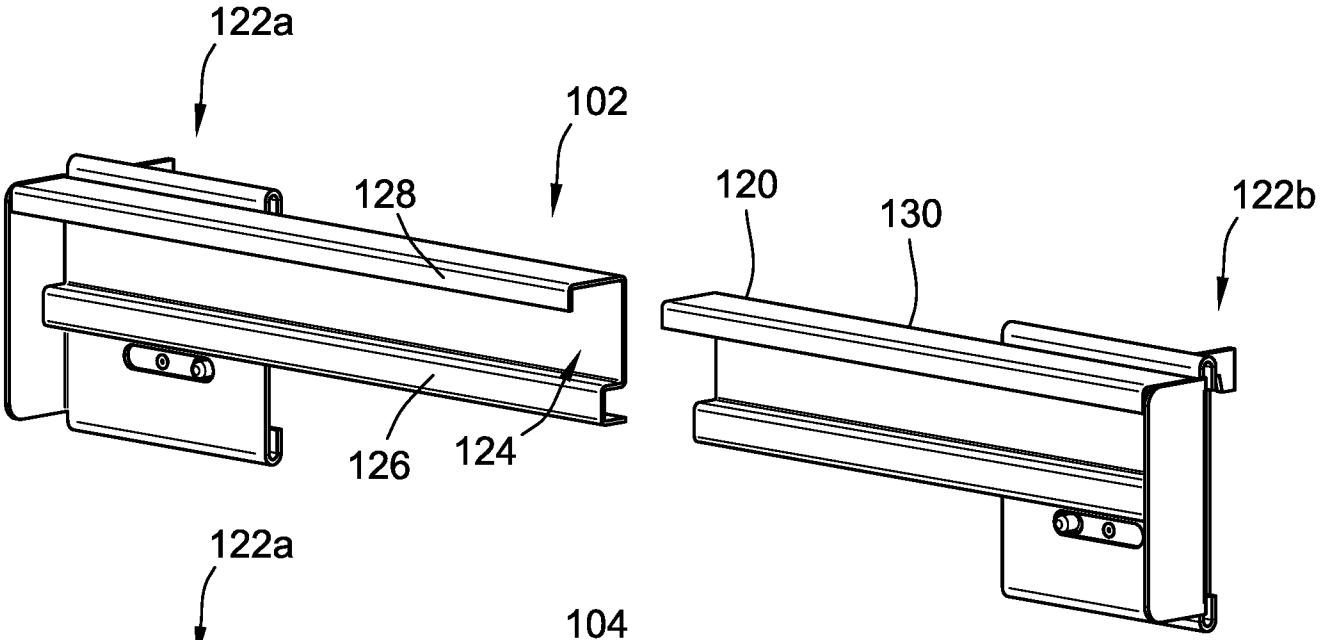
FIG. 3 is a perspective view of an upper rail of the grid assembly of FIG. 2.

Turning now to FIG. 3, the same illustrates upper rail 102. Upper rail 102 includes a rail section 120 with a pair of identical mounting brackets 122*a*, 122*b* at opposed ends of rail section 120. Rail section 120 includes a channel 124 within which the upper end 114 of each upright support 106*a-c* is slidable. Further, rail section 120 also includes a mounting shelf 126 upon which each upright support 106*a-c* mates. This configuration ensures that upright supports 106*a-c* are at a uniform height relative to one another so that the apertures 118 horizontally align.

Rail section 120 includes a lip 128 which depends downwardly from an upper wall 130 of rail section 120. This lip 128, upper wall 130, and mounting shelf 126 bound channel 124. The particular length of upper rail 102 shown should be taken by way of example only. Indeed, the length of upper rail 102 may be varied depending upon the desired sizing of shelving system 100.

Figure 4:
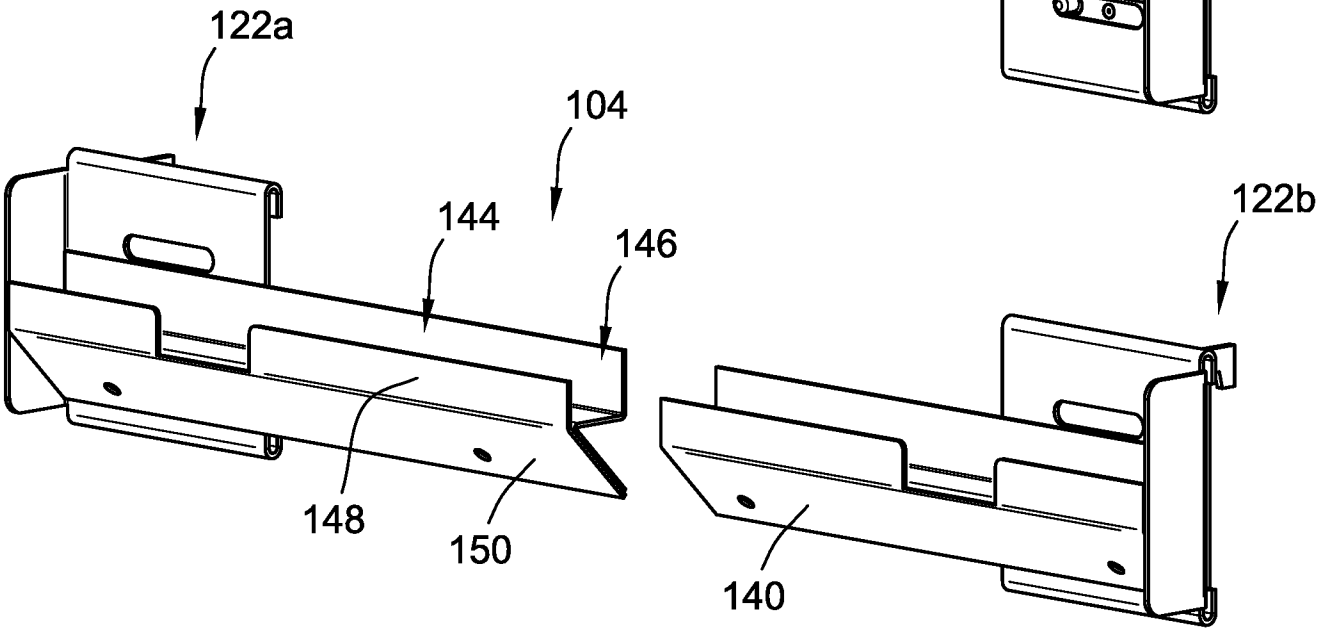
FIG. 4 is a perspective view of a lower rail of the grid assembly of FIG. 2.

Turning now to FIG. 4, the same illustrates lower rail 104. Lower rail 104 also includes a rail section 140. The same pair of identical mounting brackets 122*a*, 122*b* used in upper rail 102 (see FIG. 3) are also used in lower rail 104 as shown. Rail section 140 also includes a channel 144 within which the lower end 116 of each upright support 106*a-c* is slidable. An opening 146 is formed in rail section 140. This opening 146 allows passage of lower end 116 (see FIG. 2) of each upright support 106*a-c* from an exterior of rail section 140 into channel 144 as discussed below.

Rail section 140 includes a lip 148 which depends upwardly relative to a lower wall 150 of rail section 140. This lip 148 and lower wall 150 bound channel 144. The particular length of lower rail 104 shown should be taken by way of example only. Indeed, the length of lower rail 104 may be varied depending upon the desired sizing of shelving system 100. Further, lip 148 retains lower end 116 of upright supports 106*a-c* when situated in channel 144, preventing them from rocking away from a support structure upon which rails 102, 104 are mounted.

Figure 5:
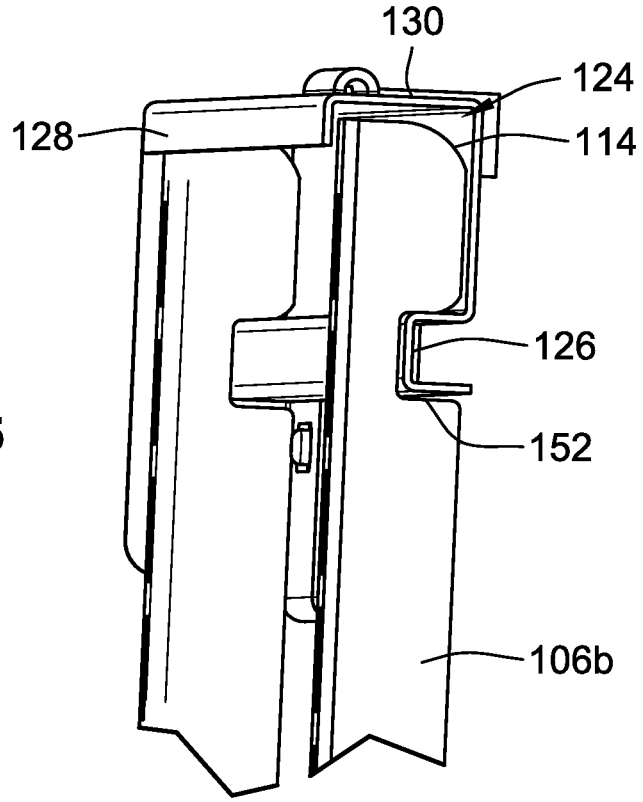
FIG. 5 is a perspective cross section of the grid assembly of FIG. 2, taken in a region of the upper rail.

Turning now to FIG. 5, the same illustrates a cross section in the region of the upper end 114 of upright support 106*b* when it is situated within channel 124. As may be seen in this view, upper end 114 closely resembles the shape of channel 124 to minimize relative movement between these structures. As may also be seen in this view, upright supports 106*a-c* each include a channel 152 which receives mounting shelf 126 as shown.

Figure 6:
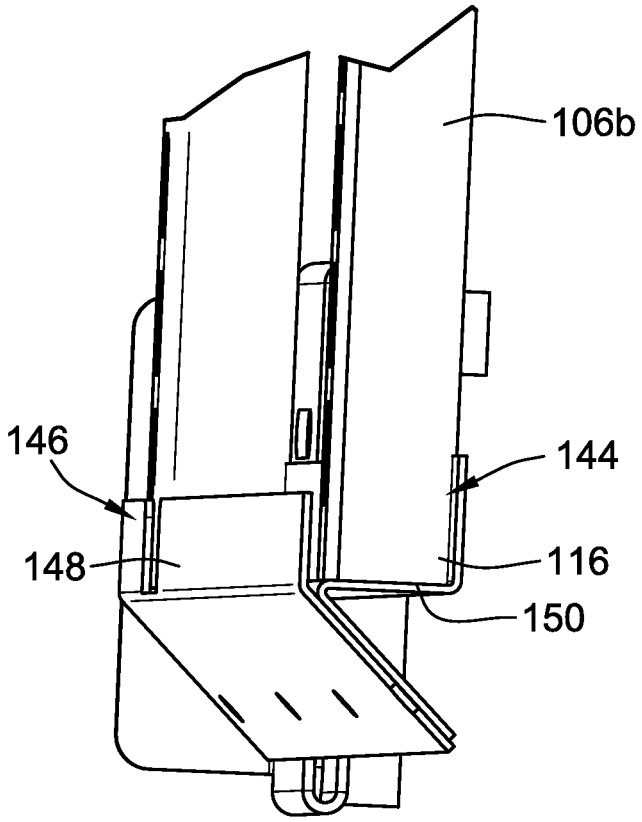
FIG. 6 is a perspective cross section of the grid assembly of FIG. 2, taken in a region of the lower rail.

Likewise, and as is shown in FIG. 6, lower end 116 closely resembles the shape of channel 144 to minimize relative movement between these structures. Lower end 144 may rest on bottom wall 150 as shown, or it may be spaced away from bottom wall 150. Indeed, the support provided by mounting shelf 126 (see FIG. 5) is sufficient to allow upright supports 106*a-c* to hang freely therefrom.

Figure 7:
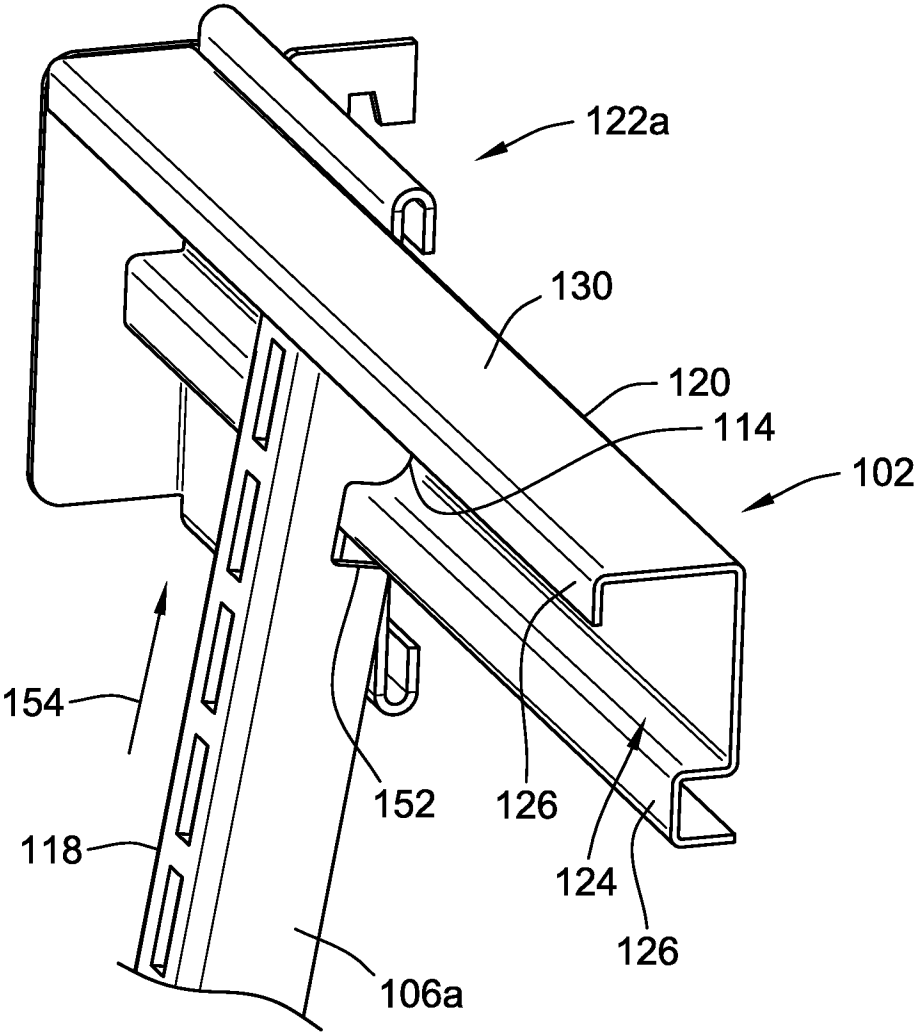
FIG. 7 is a perspective view of the upper rail of the grid assembly of FIG. 2 receiving an upper end of an upright support.
Figure 8:
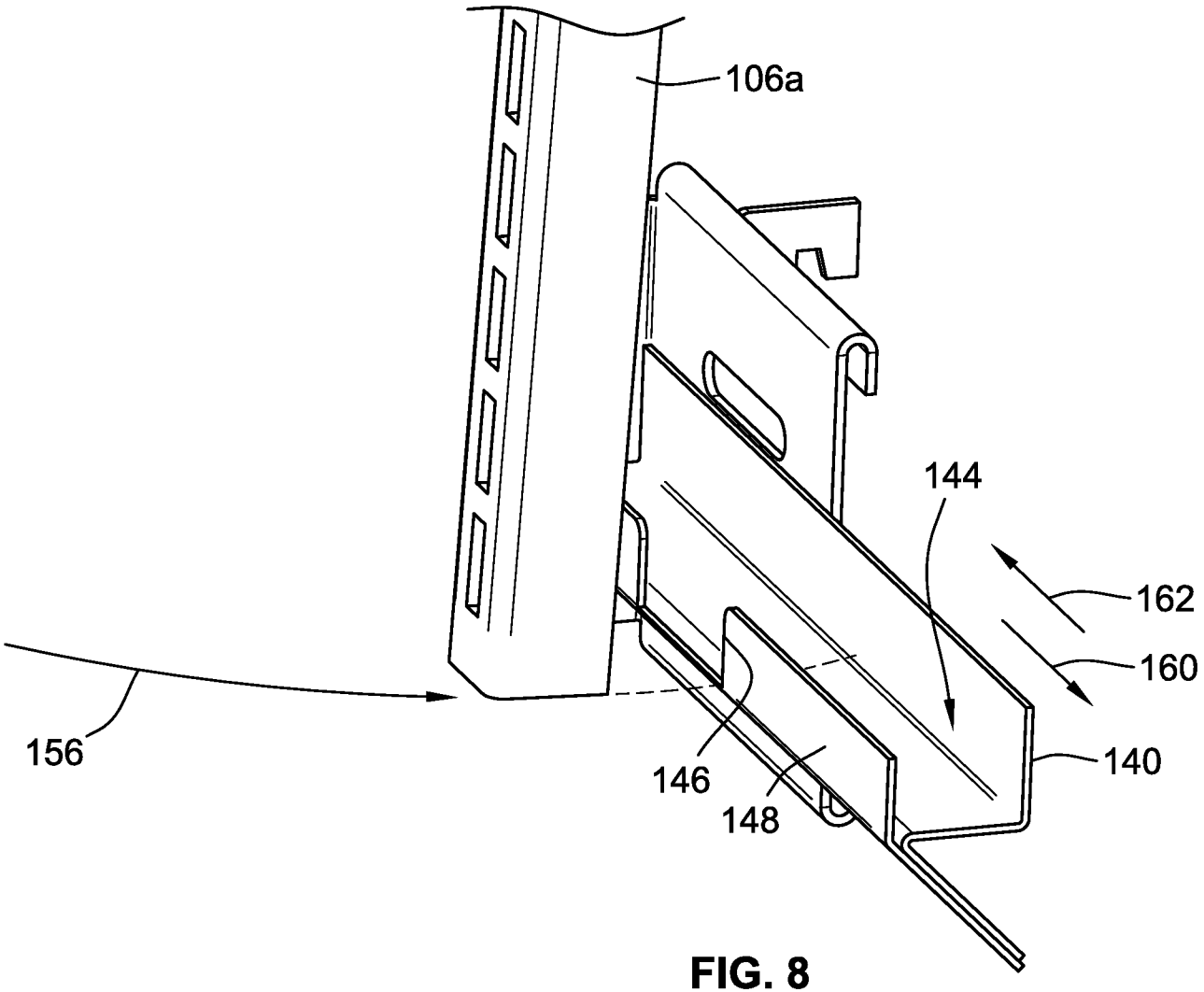
FIG. 8 is a perspective view of the lower rail of the grid assembly of FIG. 2 receiving a lower end of the upright support depicted in FIG. 7.

FIGS. 7 and 8 illustrate a typical installation operation of uprights supports 106*a-c*. As shown in FIG. 7, upright support 106*a* is brought into proximity with upper rail 102 and angled as shown. Upright support 106*a* is then moved in linear direction 154 as shown until upper end 114 is partially situated within channel 124. Thereafter, and referring now to FIG. 8, upper rail is then rotated about its upper end 114 to pivot lower end 116 in direction 156 as shown. Doing so causes lower end 116 to pass through aperture 146 in rail section 140 of lower rail 104. This operation ultimately places lower end within channel 144. Once within channels 124, 144, upright support 106*a* may be slid in directions 160, 162 to its desired location. A successive operation as described above is undertaken for each upright support installed in upper and lower rails 102, 104. It is also contemplated that the above process could be reversed relative to upper and lower rails 102, 104. Indeed, upright supports 106*a-c* could be installed into lower rail 104 first in the same manner as they are installed into upper rail 102 described above, and then installed into upper rail 102 in the same manner as they are installed into lower rail as described above. It is thus contemplated that the structure and function of upper and lower rails 102, 104 could be swapped.

Figure 9:
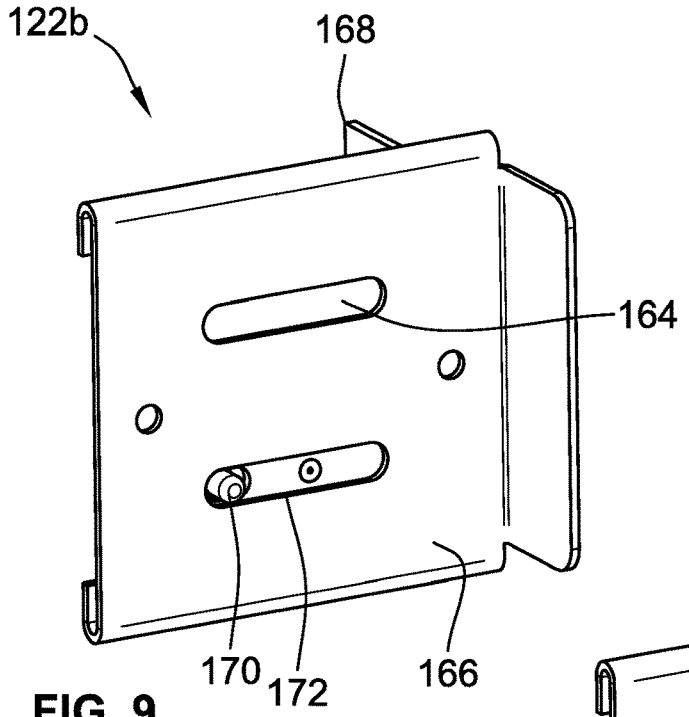
FIG. 9 is a perspective view of a mount of the grid assembly of FIG. 2.

Turning now to FIG. 9, the same illustrates an exemplary view of mounting bracket 122*b*. As noted above, mounting bracket 122*b* is identical to mounting bracket 122*a*. Mounting bracket 122*b* includes a movable plate 164 providing mounting features 168 for mounting to a support structure, and a fixed plate 166. Fixed plate 166 is fixed to its associated rail section 120, 140, while movable plate 164 is slidable relative to fixed plate 166. Movable plate 164 includes a pin 170 which is received in a slot 172 of fixed plate 166.

Figure 10:
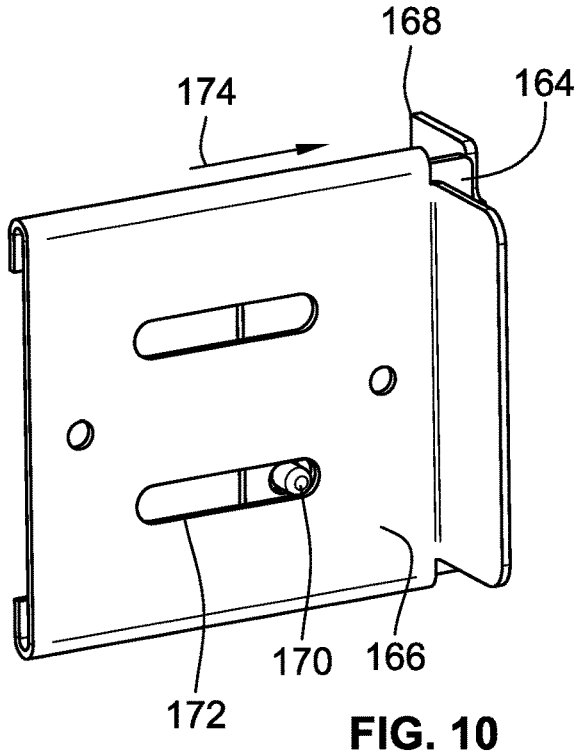
FIG. 10 is another perspective view of the mount of FIG. 9, shown in an alternate position.
Figure 11:
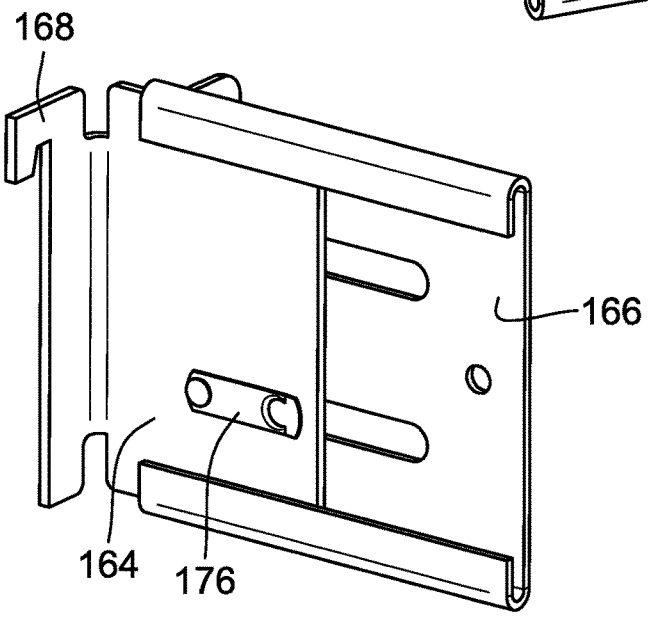
FIG. 11 is another perspective view of the mount of FIG. 9, showing a side thereof opposite that shown in FIG. 9.

Turning now to FIG. 10, this pin and slot configuration defines the amount of lateral travel movable plate 164 may undergo relative to fixed plate 166 before movable plate 164 is effectively separated from fixed plate 166. As an example in FIG. 10, movable plate 164 has moved in direction 174 relative to fixed plate 166. Such a slidable configuration allows the mounting brackets 122*a*, 122*b* to accommodate for deviations in corresponding mounting holes in a support structure arranged to receive mounting features 168. With momentary reference to FIG. 11, pin 170 attached to movable plate 164 via a leave spring 176 which may be deflected to such an extent to allow for full separation of movable plate 164 from fixed plate 166.

Figure 12:
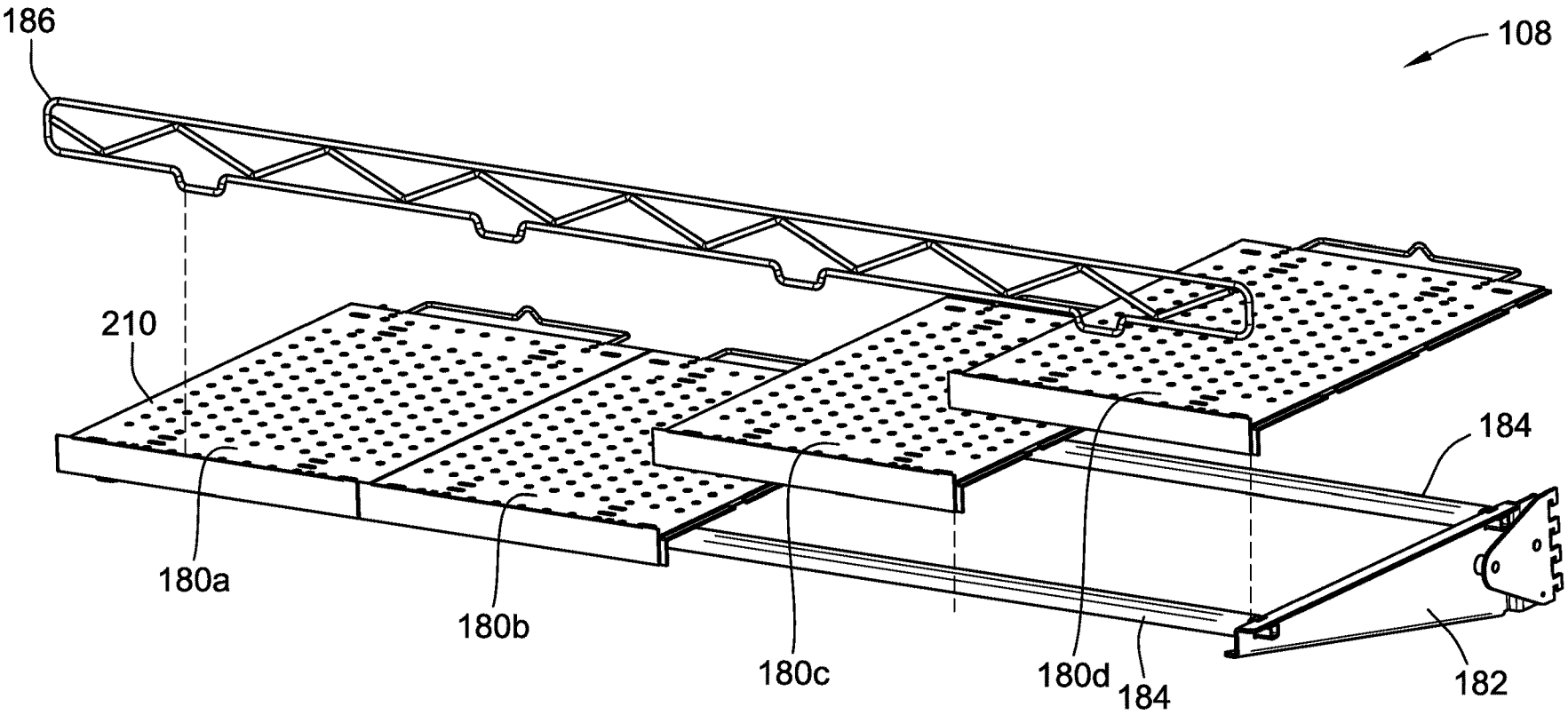
FIG. 12 is a perspective partially exploded view of a shelf of the shelving system of FIG. 1.

Turning now to FIGS. 12-19, the same illustrate shelf 108 in greater detail. With particular reference to FIG. 12, shelf 108 includes a plurality of identical deck panels 180*a*, 180*b*, 180*c*, 180*d*. Given that deck panels 180*a-d* are identical, a description of any of one of said deck panels 180*a-d* applies equally well to the others. Although four deck panels 180*a-d* are shown to accommodate for the full length of shelf 108 illustrated, shorter shelves 108 will have fewer deck panels. For example, a shelf 108 half as long as that illustrated in FIG. 12 would only have two deck panels. Further, it is also contemplated that a shelf 108 may include a single deck panel. As will be discussed below, where multiple deck panels 180*a-d* are utilized, adjacent deck panels interlock with one another to prevent lateral movement of these deck panels 180*a-d* relative to one another. As one non-limiting example, each deck panel 180*a-d* may be one foot wide. A four foot long shelf would thus employ four deck panels. Although illustrated as mounting the grid assembly discussed above relative to FIGS. 1-11, it is contemplated that shelf 108 may be configured to mount to any existing structure by minor modification of the structure it utilizes for mounting. More generally, it is contemplated by the teachings herein, that the invention may be embodied as a combined system as reflected in FIG. 1 for example, or as a stand alone shelf 108 that may be retrofit into an existing system.

Each deck panel 180*a-d* includes an upper surface 210 which is used to support merchandise. Further, deck panels 180*a-d* may include perforations as shown, or any other features typical of retail shelving, e.g. features for mounting a front fence 186 as shown, features for mounting dividers (not shown), a price channel or price channel support 232 (see FIG. 17), channels or other features for receiving and retaining lighting elements, etc. Deck panels 180*a-d* may be formed of a plastic material, for example, an acrylonitrile butadiene styrene (ABS) plastic. Such a material selection allows for the use of NSF certified materials for contacting retail items such as produce or the like.

Further, because deck panels 180*a-d* are separable and removable from the remainder of shelf 108, they may be easily cleaned in a dishwasher, sink, etc. Further, although illustrated as forming a portion of a flat shelf, deck panels 180*a-d* may take on other forms. For example, deck panels 180*a-d* may be embodied as bins or any other expedient typically used in the retail environment for containing merchandise. Yet further, although not illustrated, pusher systems and other front facing devices may be readily mounted to deck panels 180*a-d*.

Still referring to FIG. 12, in addition to deck panels 180*a-d*, shelf 108 includes first and second support arms 182 arranged at opposed sides of shelf 108. Support arms 182 are mirror images of one another, so a description of one applies equally well to the other. Shelf 108 also includes front and rear support bars 184 which are also identical to one another.

Figure 13:
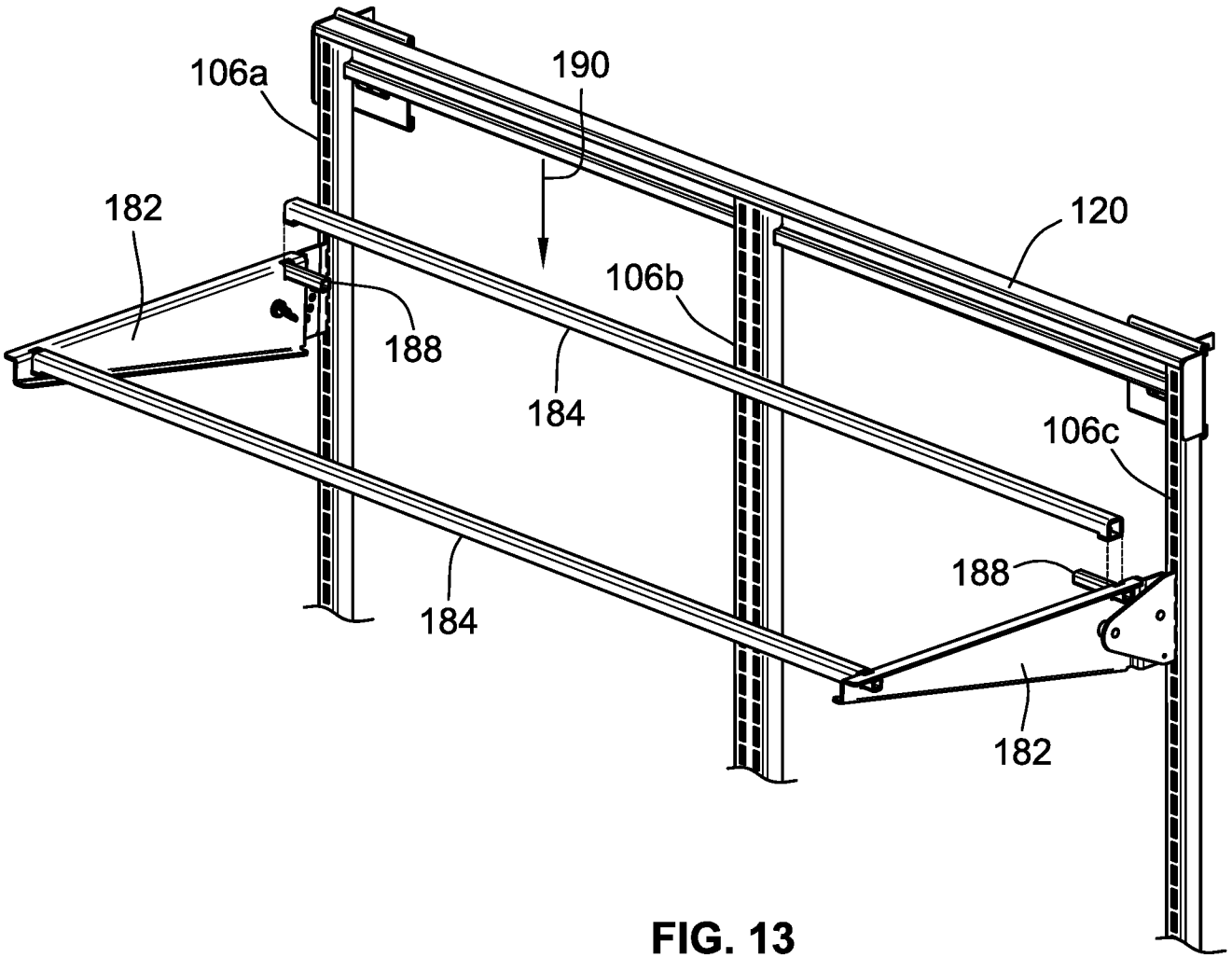
FIG. 13 is another perspective partially exploded view of the shelf of FIG. 12, shown in relation to the grid assembly of FIG. 2.

Turning now to FIG. 13, shelf 108 is rapidly installable to the above described grid assembly by the following general process. First, each support arm 182 is mounted to a respective upright support 106*a-c*. In the illustrated embodiment the left-most support arm 182 is mounted to upright support 106*a*, and the right-most support arm 182 is mounted to upright support 106*c*. Thereafter, each support bar is 184 is installed by moving the same generally in direction 190 until a support post 188 of each support arm 182 is situated within a channel of each support bar 164 as discussed below. Once support bars 184 are in place, each deck panel 180*a-d* is then successively affixed in place to support bars 184 as discussed below.

Alternatively, where support bars 184 are closed profile tubular elements, it is also contemplated that each support bar 184 is installed by horizontally sliding it onto the mounting post 188 of each support arm 182. Such an operation may be done prior to installing support arms 182 onto their associated upright support. Further, although a front and rear support bar 184 are shown, it is contemplated that for deeper shelf lengths, additional support bars 184 intermediate of front and rear support bars 184 could be utilized as well. Likewise, it is also contemplated that shallower shelf depths may only require a single support bar 184. As such, it is contemplated that at least one support bar 184 may be utilized for supporting the deck panel or panels 180*a-d* of shelf 108.

Still further, although shelf 108 is described as mounting to two separate upright supports 106*a*, 106*c*, it is contemplated that shelf 108 may mount to a single upright support. Such a single upright support may be wider than those shown to accommodate mounting multiple support arms 182. For example, shelf 108 may mount to upright support 106*b* alone. Upright support 106*b* includes a double row of apertures 118 and can thus accommodate two support arms. The overall width of such a single upright support 106*b* may be varied to accommodate varying shelf lengths. As such, it is contemplated that at least one upright support is all that is required at a minimum for shelf mounting.

It will be recognized from the foregoing that all of the componentry of shelf 108 may be readily assembled and disassembled without the use of any special tools, or without destroying or disfiguring any portion of shelf 108. Such a configuration is a distinct departure from prior designs which typically employ welded structures for their shelves, making the same heavy and generally cumbersome when the same are installed, or periodically removed for cleaning.

It will also be recognized from the foregoing, that shelf 108 presents a highly modular design. Indeed, as one non-limiting example, shelf 108 may be readily adapted to a shelf having half of the length shown by remounting one of support arms 182 on upright support 106*b*, and utilizing shorter support bars 184. Thereafter, two deck panels (instead of the four shown) can then be snapped onto these shorter support bars 184.

Figure 14:
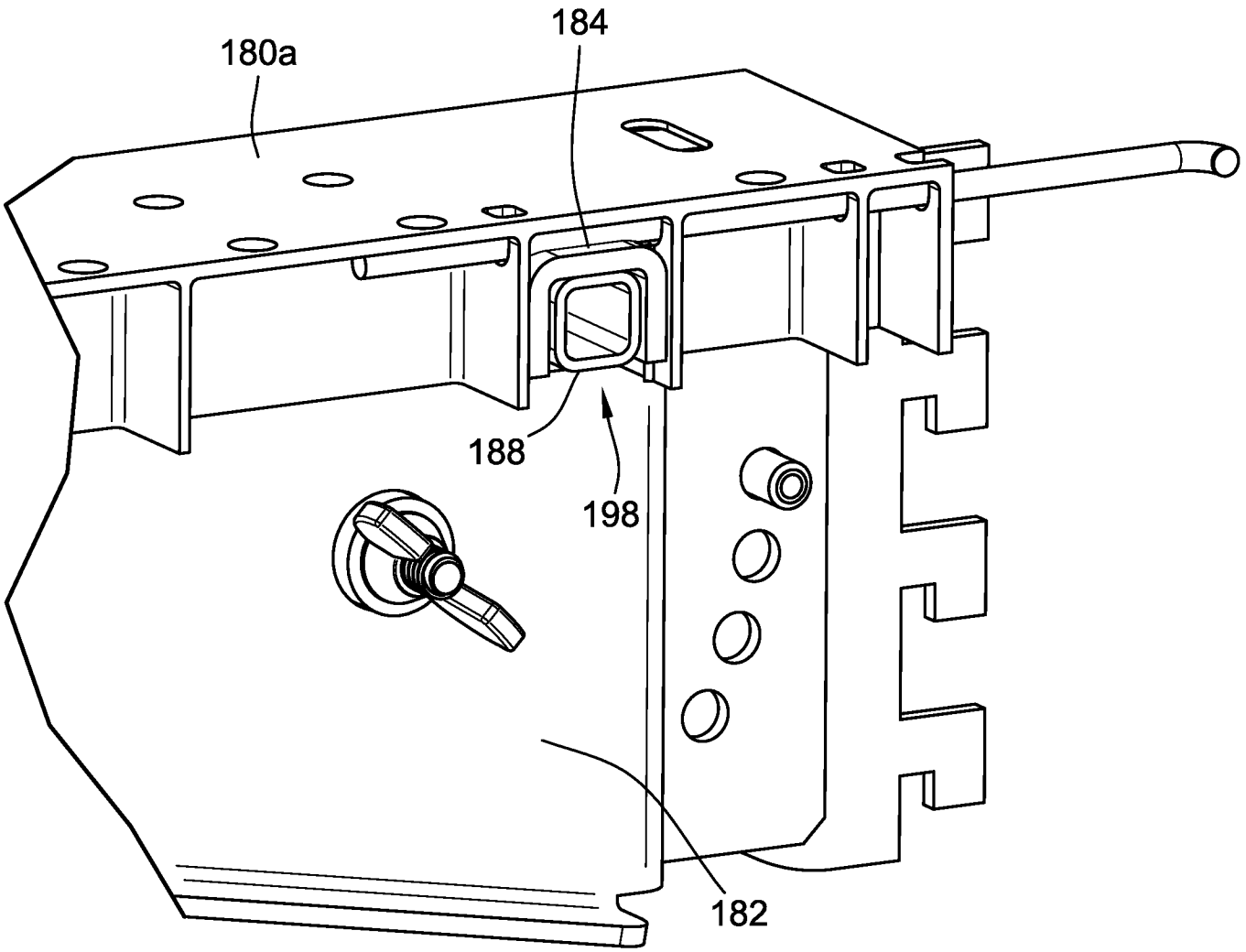
FIG. 14 is a cross section of a portion of the shelf of FIG. 12.

FIG. 14 illustrates a cross section taken in the region of the interface between a mounting post 188 of the left-most support arm 182 shown in FIG. 13 and rear support bar 184. As can be seen in this view, mounting post 188 is situated within a channel 196 of support bar 184. An identical configuration exists at the other end of this support bar 184, as well as at both ends of the front support bar 184 shown in FIG. 13. Each support bar 184 is supported by two mounting posts 188 by resting upon the same, without being permanently attached to these mounting posts 188, and thus presents a selectively removable style of assembly. It is also contemplated that channel 196 of each support bar 184 may be open sided as shown, or may be partially or fully enclosed in the event that support bars 184 are partially or entirely tubular elements, as opposed to having a generally U-shaped cross section as shown.

Figure 15:
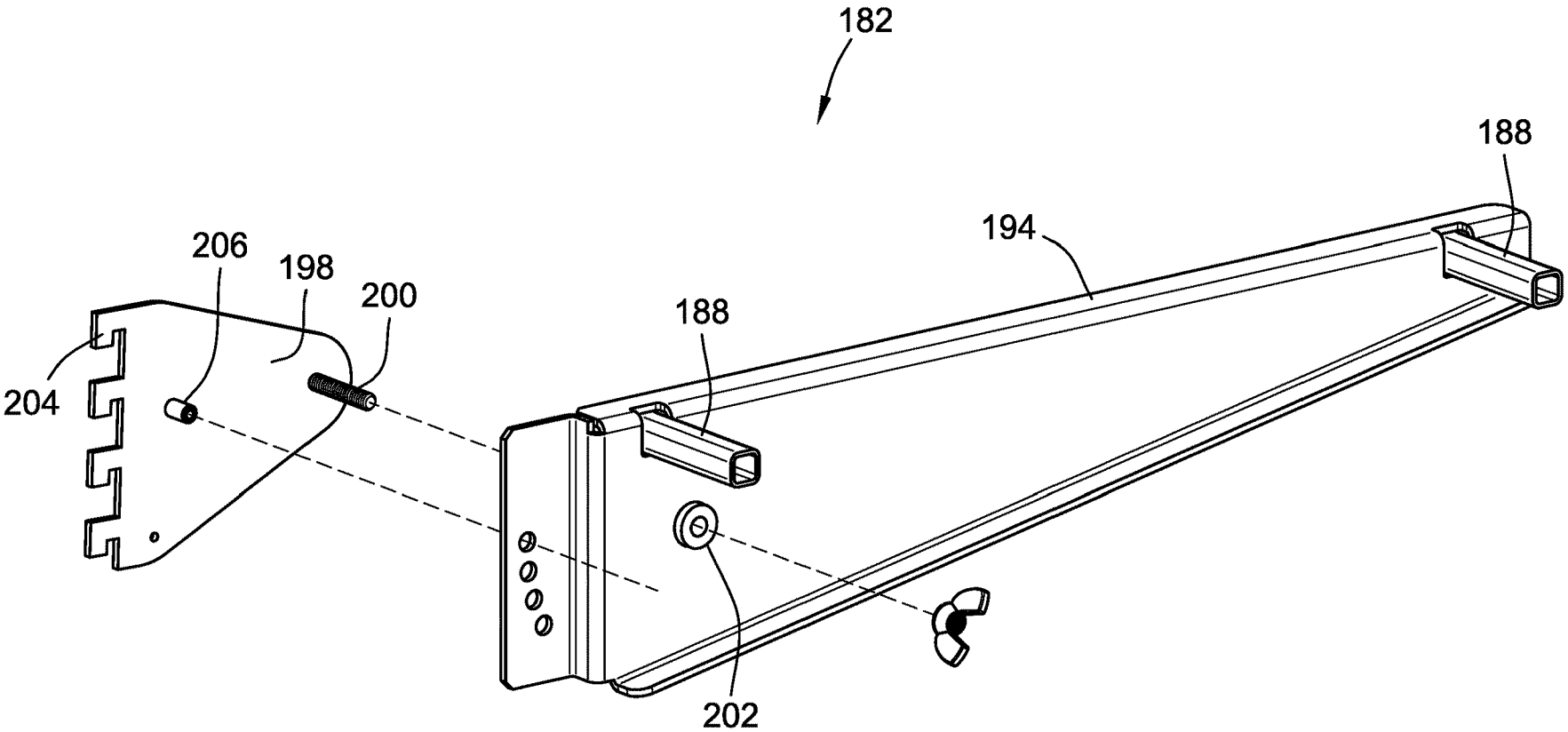
FIG. 15 is a perspective exploded view of a support arm of the shelf of FIG. 12.
Figure 16:
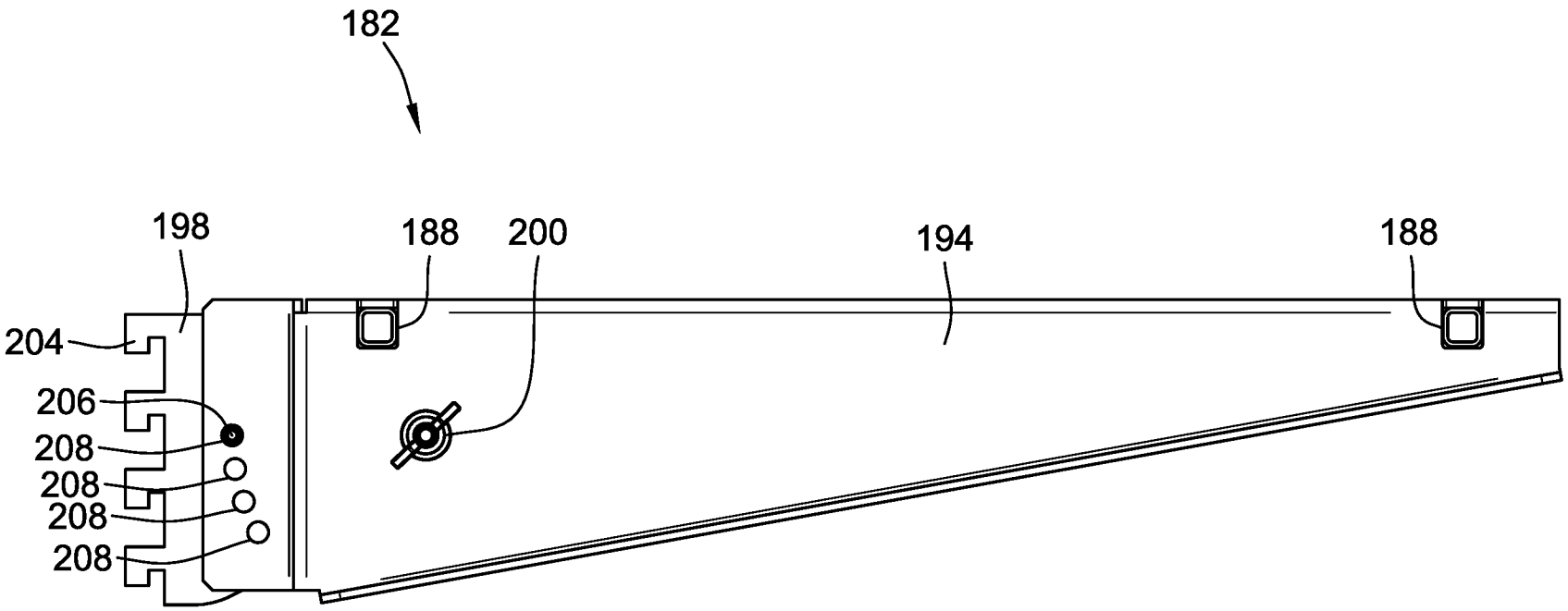
FIG. 16 is a side view of the support arm of FIG. 15.

With reference now to FIG. 15, the same illustrates an exploded view of a support arm 182. Each support arm 182 includes a main body 194 and an adjustable plate 198 mounted to main body 194. Each mounting post 188 is fixed to, and depends from, main body 194 as shown. Adjustable plate 198 attaches to main body 194 via a threaded fastener 200 as shown. Threaded fastener 200 extends through an aperture 202 of main body 194 and a wing nut or the like may then be used to tighten main body 194 and adjustable plate 198 together. Adjustable plate 198 also includes mounting features 204 which are received in the apertures 118 of upright supports 106*a-c* (see e.g. FIG. 2). These mounting features 204, however, can take any suitable form so as to facilitate the mounting of shelf 108 to any pre-existing structure.

Adjustable plate 198 also includes a pin 206 which is received in one of a plurality of apertures 208 (see FIG. 16) formed in main body 194. The angular presentation of each support arm 182 as it extends outwardly in a cantilevered manner from its associated upright support 106*a-c* is governed which of the apertures 208 pin 206 is received in. For example, as may be seen in FIG. 16, when pin 206 is received in the upper most aperture 208, main body 194 is essentially level, e.g. horizontal, compared to adjustable plate 198. However, by removing any hardware securing fastener 200, one may reposition adjustable plate 986 relative to main body 194 (or vice versa) and insert pin 206 into a different one of apertures 208.

Figure 17:
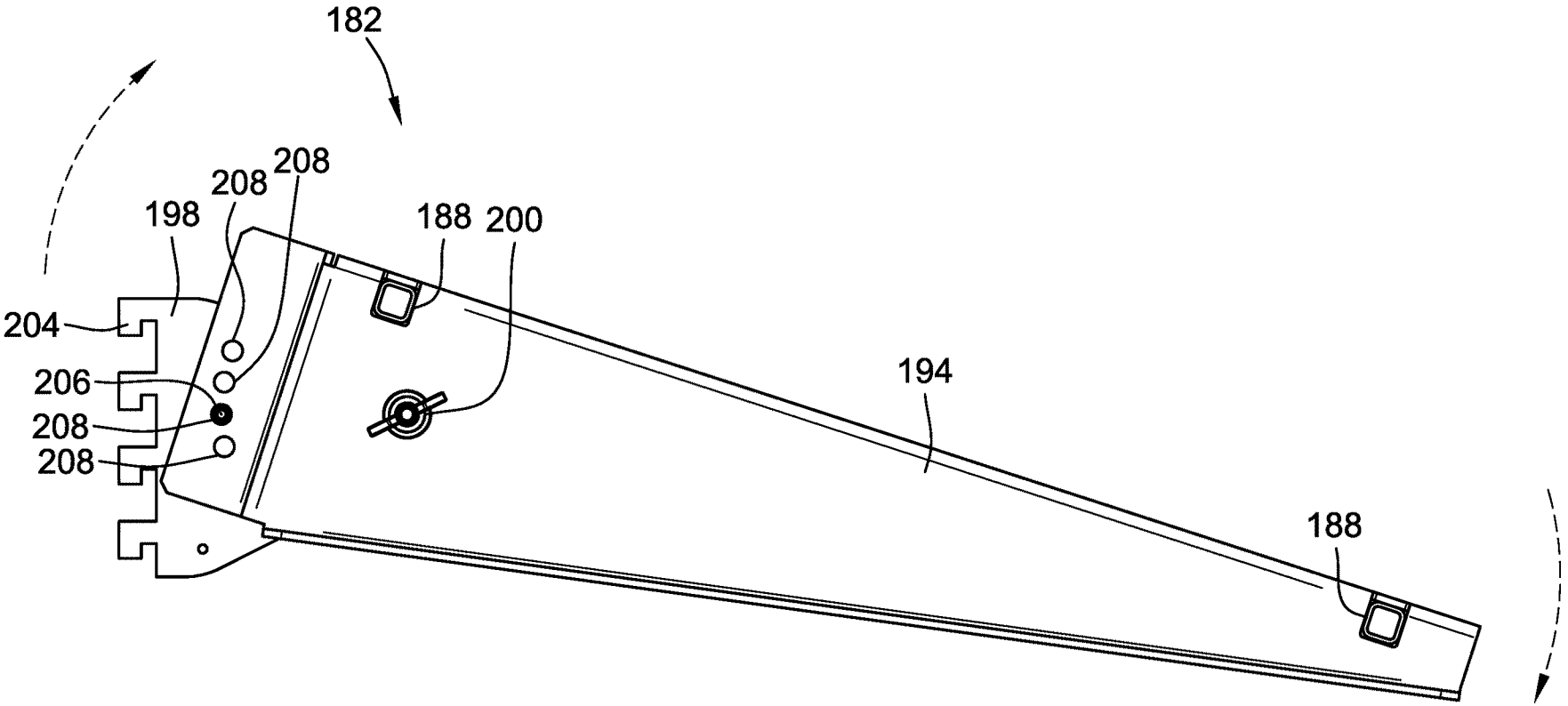
FIG. 17 is another side view of the support arm of FIG. 15, showing an alternate configuration thereof from that shown in FIG. 16.

For example, and turning now to FIG. 17, the same illustrates pin 206 in the third aperture down on main body 194. This causes main body, and hence support bars 184 and deck panels 180*a-d* mounted to supports bars 184 to, to tilt as shown. As a result, by this expedient manipulation, the user can readily govern the angle of shelf 108. Such a configuration is advantageous, for example, where the user desires to angle shelf 108 to provide a gravity feed function.

Figure 18:
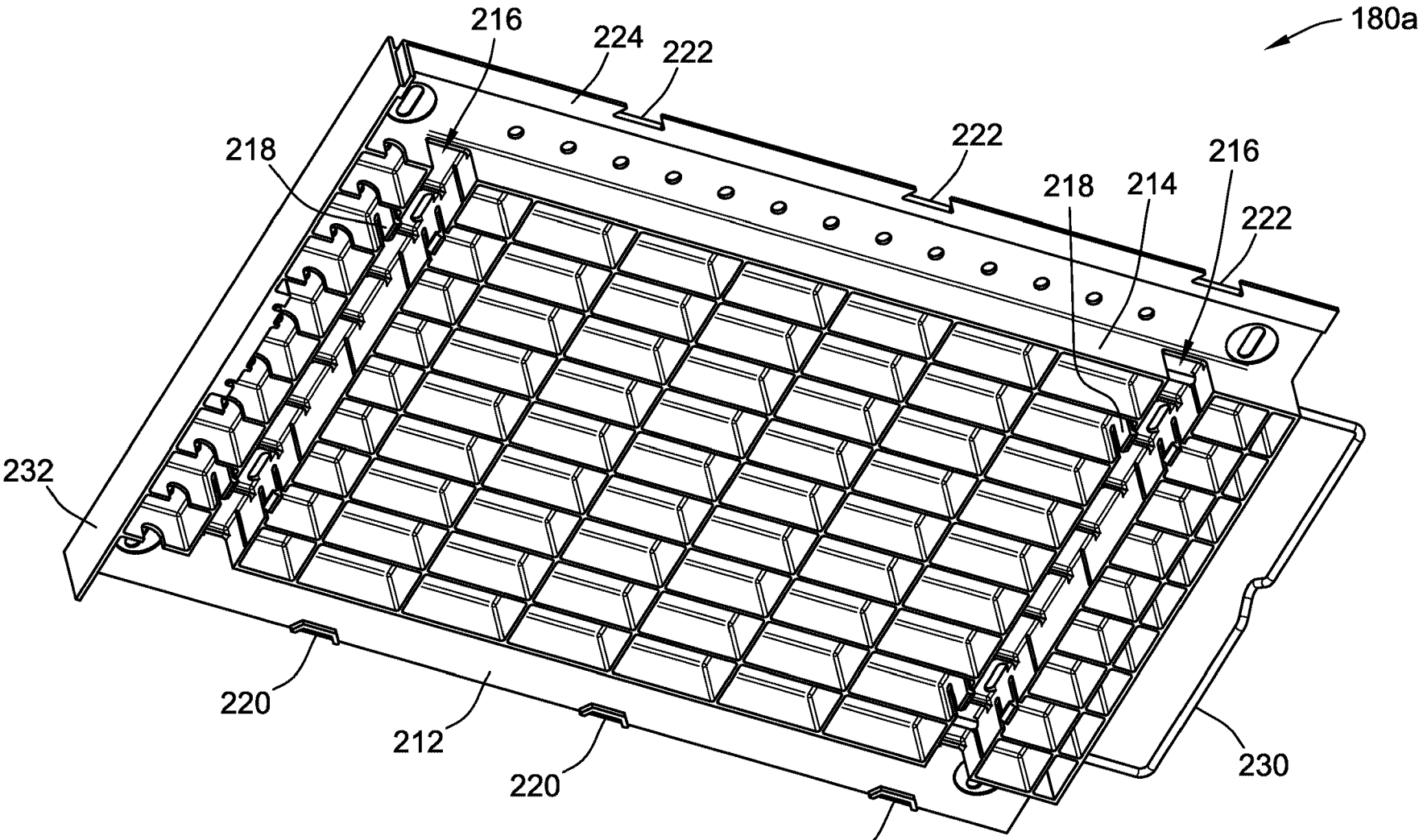
FIG. 18 is a perspective view of a deck panel of the shelf of FIG. 12.

FIG. 18 illustrates another perspective view of deck panel 180*a*, and in particular shows a bottom surface 112 thereof. Deck panel 180*a* includes a honeycomb strengthening structure 214 depending from its bottom surface 212. A front and a rear channel 216 extend through this honeycomb structure 214 for receiving each support bar 184, respectively, therein. Each channel 216 includes finger tabs 218 which may snap around its associated support bar 184 to secure deck panel 180*a* to support bars 184. Although a front and rear channel 214, 216 are shown, the number of channels utilized may be varied to accommodate fewer or greater support bars 184.

Further, deck panel 180*a* also includes a d wire baffle support 230 for mounting a baffle plate thereto. Such a baffle plate may take on any form useful for directing air flow in a desired path. This wire baffle support 230 is slidable relative to deck panel 180*a* to allow for selective positioning of such a baffle plate.

The above introduced interlocking capability of deck panels 180*a-d* is achieved via interlocking features arranged adjacent opposed side edges of each deck panel 180*a-d*. In the example of deck panel 180*a* shown, these interlocking features include a plurality of tabs 220 adjacent one side edge which extend downwardly from bottom surface 212 as shown. These interlocking features also include a lip with a plurality of openings 222 arranged adjacent the other side edge as shown. Tabs 220 are received in openings 222 of an adjacent deck panel. Likewise, openings 222 receive tabs 220 of an adjacent deck panel. This interlocking feature ensures that adjacent deck panels cannot laterally move along support bars 184 relative to one another once interlocked. Although described as identical, it is also contemplated that end panels may be employed as the left-most and/or right-most panels in the row of interlocked deck panels. In the case of a right-most end panel, the same would omit the lip and openings 222 to provide a cleaner edge on the right most side of the shelf surface. In the case of the left-most end panel, the same would omit the tabs 220 for the same purpose.

Figure 19:
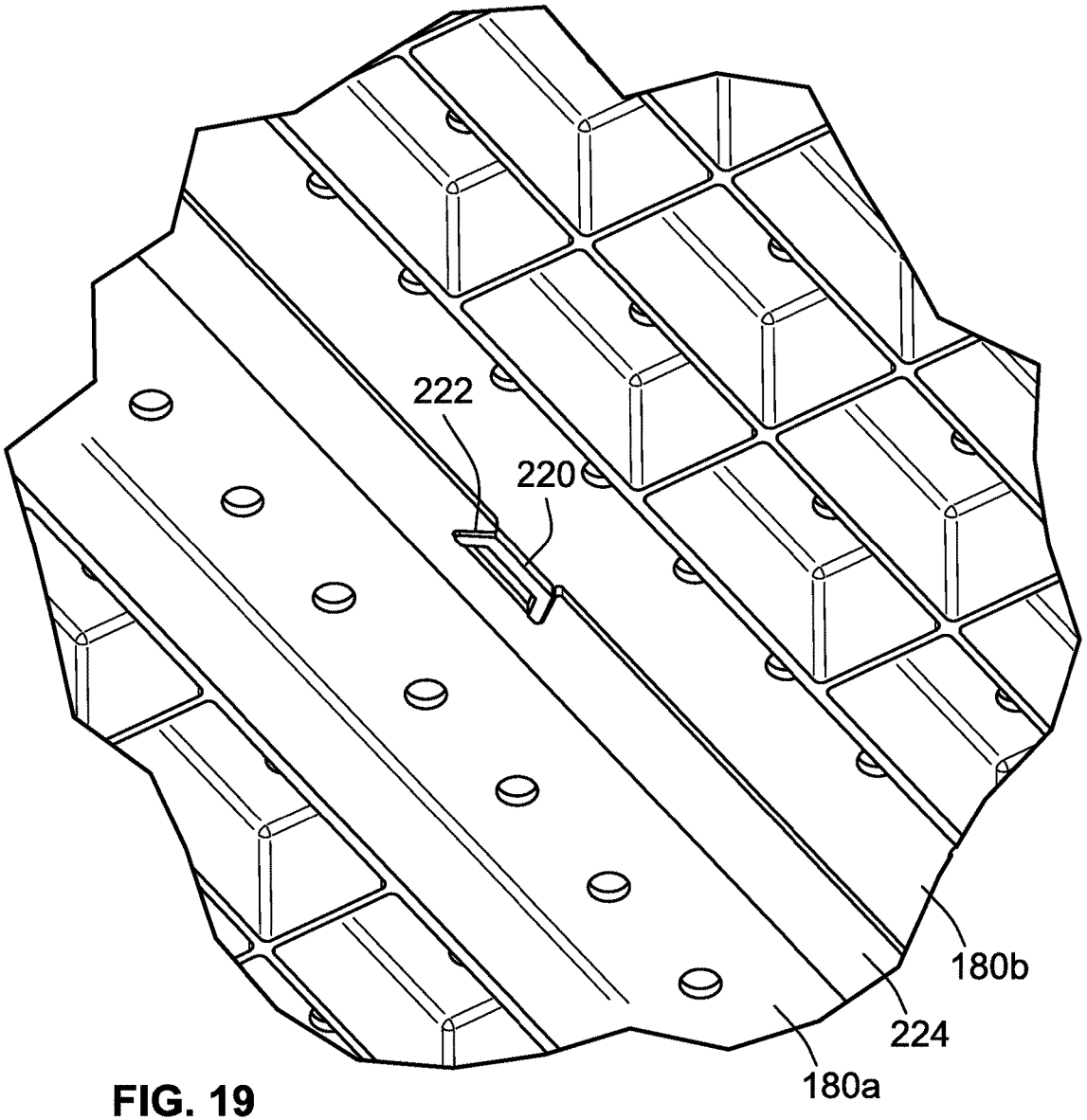
FIG. 19 is perspective view of an overlapped joint formed between adjacent deck panels.

FIG. 19 illustrates one tab 220 interlocked in one opening 222. Tabs 220 vertically enter openings 222. Once situated, tabs 220 are horizontally constrained within openings 222 due to their complimentary dove-tail shape. As a result, adjacent deck panels cannot laterally move along support bars 184 relative to one another once interlocked.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A shelving system, comprising:

an upper rail defining an upper channel, the upper rail configured to mount to a support structure;

at least one upright support, wherein the at least one upright support has an upper end and a lower end, the upper end received in the upper channel and slidable within said upper channel;

at least one shelf mounted to the at least one support;

a lower rail configured to mount to the support structure separately from the upper rail, wherein the lower rail includes a bottom wall and a lip extending upwardly from the bottom wall, the bottom wall and lip bounding a lower channel that is positioned rearward of the lip, the lower channel being closer to the support structure than the lip when the lower rail is mounted to the support structure, the lip of the lower rail including at least one access opening sized to permit the lower end of the at least one upright support to pass therethrough allowing access through the lip of the lower rail to the lower channel, the lower end of the at least one upright support received in the lower channel rearward of the lip and slidable within the lower channel behind the lip, wherein the at least one upright support includes first and second upright supports, and wherein the at least one shelf comprises:

a first and a second support arm, the first support arm mounted to one of the first and second upright supports, the second support arm mounted to the other one of the first and second upright supports, the first and second support arms arranged in opposed spaced relation to one another;

a front support bar extending between the first and second support arms;

a rear support bar extending between the first and second support arms; and at least one deck panel supported by the front and rear support bars, the at least one deck panel configured to interlock with an adjacent deck panel such that the at least one deck panel is prevented from laterally moving relative to the adjacent deck panel along the front and rear support bars.

2. The shelving system of claim 1, wherein the upper rail includes a mounting shelf, and wherein the at least one upright support includes a channel for receiving the mounting shelf.

3. The shelving system of claim 1, wherein the upper rail includes an upper wall and a lip depending downwardly from the upper wall which bounds the upper channel.

4. The shelving system of claim 3, wherein an extension length of the lip of the upper rail from the upper wall is less than an extension length of the lip of the lower rail from the bottom wall.

5. The shelving system of claim 4, wherein each of the upper and lower rails includes a pair of mounting structures for mounting the upper and lower rails to the support structure.

6. The shelving system of claim 5, wherein each of the pair of mounting rails includes a front plate and a back plate, the back plate slidable relative to the front plate.

7. The shelving system of claim 1, wherein the first and second support arms each include a front mounting post and a rear mounting post.

8. The shelving system of claim 7, wherein the front support bar includes a channel, the channel of the front support bar receiving the front mounting posts of the first and second support arms such that the front support bar is selectively removable from the first and second support arms, and wherein the rear support bar includes a channel, the channel of the rear support bar receiving the rear mounting posts of the first and second support arms such that the rear support bar is selectively removable from the first and second support arms.

9. The shelving system of claim 1, wherein the at least one deck panel includes a plurality of tabs extending from a bottom surface of the deck panel, the plurality of tabs configured to be received in corresponding openings of the adjacent deck panel, and wherein the at least one deck panel includes a lip, the lip providing a plurality of openings for receiving a plurality of tabs of the adjacent deck panel.

10. The shelving system of claim 3, wherein:

the at least one upright support is rotatably connected to the upper rail;

the at least one upright support is rotatable relative to the upper rail to pass through the opening in the lower rail when the at least one upright support is located in the channel of the upper rail and the upper end of the at least one upright support is located behind the lip of the upper rail; and the lip of the upper rail and the portion of the lip of the bottom rail offset from the opening preventing removal of the at least one upright support from the upper and lower rails.

11. The shelving system of claim 1, wherein the at least one upright support is rotatably connected to the upper rail for rotation about an axis of rotation; and the at least one upright support is slidable within the channel of the lower rail and slidable relative to the upper rail parallel to the axis of rotation.

12. The shelving system of claim 11, wherein when mounted to the upper and lower rails, only the upper and lower rails prevent rotation of the at least one upright support about the axis of rotation.

13. The shelving system of claim 1, wherein:

the at least one upright support is rotatably connected to the upper rail;

the at least one upright support rotatable relative to the upper rail to pass the lower end of the at least one upright support through the opening in the lower rail and into the channel of the lower rail; and the portion of the lip of the bottom rail offset from the opening preventing removal of the at least one upright support from the upper and lower rails when the at least one upright support is laterally offset from the opening and located within the channel of the lower rail.

14. The shelving system of claim 13, wherein the lower end of the at least one upright support is prevented from being pivoted outward away from the lower rail when the lower end is offset from the opening and located within the channel while the at least one upright support is still permitted to slide along the upper and lower rails.

15. A retail shelving system, comprising:

an upper rail configured to mount to a support structure and including an upper channel;

a lower rail configured to mount to a support structure and including a lower channel;

at least two upright supports extending between the upper and lower rails, each of the at least two upright supports having an upper end and a lower end, each upper end received in the upper channel, each lower end received in the lower channel, the at least two upright supports slidable in the upper and lower channels while the lower end is prevented from being pivoted outward and away from the lower rail in a direction perpendicular to which the lower end is slidable within the lower channel;

at least one shelf mounted to the at least two upright supports;

wherein each shelf includes:

a first and a second support arm, each of the first and second support arms including a front mounting post and a rear mounting post;

a front support bar extending between the first and second support arms, the front support bar including a channel, the channel of the front support bar receiving the front mounting posts of the first and second support arms such that the front support bar is selectively removable from the first and second support arms;

a rear support bar extending between the first and second support arms, the rear support bar including a channel, the channel of the rear support bar receiving the rear mounting posts of the first and second support arms such that the rear support bar is selectively removable from the first and second support arms; and at least one deck panel supported by the front and rear support bars.

16. The shelving system of claim 15, wherein the at least one deck panel configured to interlock with an adjacent deck panel.

17. The shelving system of claim 16, wherein the at least on deck panel includes a front and a rear channel for receiving the front and rear support bars, respectively.

18. The shelving system of claim 16, wherein the at least one deck panel includes opposed side edges, wherein a plurality of tabs extend from a bottom surface adjacent one of the opposed side edges of the deck panel, and wherein the at least one deck panel includes a lip adjacent the other one of the opposed side edges, the lip providing a plurality of openings for receiving a plurality of tabs of the adjacent deck panel.

19. A method of installing a shelving system, the method comprising:

mounting an upper rail having an upper channel to a support structure;

mounting a lower rail having a lower channel to the support structure;

mounting, rotatably, an upper end of at least one upright support to the upper rail such that the upper end of the at least one upright support is disposed within the upper channel; and mounting a lower end of the at least one upright support to the lower rail by rotating the at least one upright support relative to the upper rail while the upper end is located within the upper channel such that the lower end passes through an opening in the lower mounting rail into the lower channel and sliding the at least one upright support within the lower channel to offset the lower end from alignment with the opening such that the lower end of the at least one upright cannot pass through the opening mounting a first support arm of at least one shelf to the at least one upright support;

mounting a second support arm of the at least one shelf to a second upright support;

situating at least one support bar such that it extends between the first and second support arms;

affixing a first deck panel onto the at least one support bar; and affixing a second deck panel onto the at least one support bar such that the first and second deck panels interlock.

20. The method of claim 19, wherein the step of mounting the at least one upright support includes mounting a first and a second upright support to the upper rail, and further comprises linearly inserting the upper end of each of the first and second upright supports into the upper channel, and sliding the first and second upright supports into first and second positions, respectively.

21. The method of claim 19, wherein the step of situating the at least one support bar includes situating front and rear support bars on a mounting post of each support arm within a channel of each support bar.

22. The method of claim 19, wherein the step of sliding the at least one upright support includes sliding the at least one upright support parallel to an axis about which the at least one upright support is rotated as the lower end passes through the opening the in the lower rail.

* * * * *